US006736074B2

(12) United States Patent
Pistner et al.

(10) Patent No.: US 6,736,074 B2
(45) **Date of Patent: *May 18, 2004**

(54) LIGHTWEIGHT WOOD SUBSTITUTE SUPPORT MEMBER

(75) Inventors: William W. Pistner, St. Marys, PA (US); Donald W. Pistner, St. Marys, PA (US); Daniel H. Pistner, Kersey, PA (US); Thomas G. Pistner, St. Marys, PA (US); Dennis H. Pistner, St. Marys, PA (US)

(73) Assignee: St. Marys Box Co. Inc., St. Marys, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/378,351

(22) Filed: Mar. 3, 2003

(65) Prior Publication Data

US 2004/0045486 A1 Mar. 11, 2004

Related U.S. Application Data

(63) Continuation-in-part of application No. 10/241,498, filed on Sep. 11, 2002, now Pat. No. 6,612,247.

(51) Int. Cl.[7] ..... B65D 19/00
(52) U.S. Cl. ..... 108/51.3
(58) Field of Search ..... 108/51.3, 51.11, 108/56.3, 57.18, 57.22

(56) References Cited

U.S. PATENT DOCUMENTS

| | | | | |
|---|---|---|---|---|
| 2,388,730 A | | 11/1945 | Fallert | |
| 2,432,295 A | * | 12/1947 | Donahue | 108/52.1 |
| 2,493,562 A | * | 1/1950 | Yarman | 108/51.3 |
| 2,691,500 A | | 2/1952 | Baumann | |
| 3,007,663 A | | 11/1961 | Huck | |
| 3,434,434 A | | 3/1969 | Horton, Jr. | |
| 3,464,371 A | | 9/1969 | Gifford | |
| 3,650,459 A | | 3/1972 | Tucker | |
| 3,661,099 A | | 5/1972 | Shelor | |
| 3,940,101 A | * | 2/1976 | Heidelbach | 248/346.4 |
| 4,319,530 A | | 3/1982 | Moog | |
| 4,793,519 A | | 12/1988 | Voorhies, Jr. | |
| 4,930,661 A | | 6/1990 | Voorhies | |
| 4,941,309 A | | 7/1990 | Fluent et al. | |
| 5,024,045 A | | 6/1991 | Fluent et al. | |
| 5,076,176 A | | 12/1991 | Clasen | |
| 5,218,913 A | * | 6/1993 | Winebarger et al. | 108/51.3 |
| 5,267,663 A | | 12/1993 | Dykhouse | |
| 5,269,219 A | | 12/1993 | Juvik-Woods | |
| 5,411,786 A | | 5/1995 | Kuo | |
| 5,433,156 A | | 7/1995 | Hutchison | |
| 5,448,956 A | * | 9/1995 | Ong et al. | 108/51.3 |
| 5,495,810 A | * | 3/1996 | Yoshii | 108/51.3 |
| 5,509,620 A | | 4/1996 | Crews | |
| 5,595,125 A | | 1/1997 | Bridges, Jr. | |
| 5,784,971 A | | 7/1998 | Chang | |
| 5,797,832 A | | 8/1998 | Ong et al. | |
| 5,832,841 A | * | 11/1998 | Crews et al. | 108/51.3 |
| 5,934,202 A | | 8/1999 | Lai | |
| 5,941,177 A | | 8/1999 | Anderson | |
| 6,076,475 A | | 6/2000 | Kuhn et al. | |
| 6,357,364 B1 | | 3/2002 | Maloney et al. | |
| 6,612,247 B1 | * | 9/2003 | Pistner et al. | 108/51.3 |

FOREIGN PATENT DOCUMENTS

| | | | |
|---|---|---|---|
| JP | 6-239346 | * | 8/1994 |

* cited by examiner

*Primary Examiner*—Jose V. Chen
(74) *Attorney, Agent, or Firm*—Hudak, Shunk & Farine, Co. LPA

(57) ABSTRACT

The disclosure relates to a lightweight support member or article prepared from corrugated paper which is utilized as a replacement for wood articles such as logs, boards, planks and the like. The support members have a high strength to weight ratio and save on transportation and fuel costs. The support members are constructed as a continuous or semi-continuous, flattened or elongated wind of corrugated paper around a core or central area.

20 Claims, 3 Drawing Sheets

LIGHTWEIGHT WOOD SUBSTITUTE SUPPORT MEMBER

CROSS REFERENCE

This application is a continuation-in-part of prior application Ser. No. 10/241,498, filed Sept. 11, 2002, now U.S. Pat. No. 6,612,247 entitled "Corrugated Shipping Pallet," herein fully incorporated by reference.

FIELD OF THE INVENTION

The present invention relates to support members which can be used as a substitute for wood logs, boards, or planking. The support members are preferably constructed from corrugated paper and are lightweight while having high strength. The support members can be utilized to brace, stabilize, or support various items.

The present invention relates to a pallet or load carrying structure which can be manufactured from corrugated paper or similar materials which are recyclable. The pallets are utilized to carry goods, materials, etc. and are advantageously lightweight, thus saving transportation costs. The structure of the pallet provides excellent stability and yet allows for production costs to be minimized.

BACKGROUND OF THE INVENTION

Industries such as transportation and manufacturing have for years utilized wood articles such as logs, boards, and planking as supports, braces, and separators for various goods or other materials. While wood articles have been known to be durable, they have numerous drawbacks.

Disadvantages include that wood is relatively dense and thus heavy. The weight of wood articles increases transportation costs and reduces the amount of materials which can be transported. A further disadvantage is that wood surfaces are rough and generally uneven which can damage the finish of materials, especially fragile materials, abutted or supported thereby. Moreover, when exposed to moisture, wood articles can warp, becoming unlevel and not suitable for intended uses.

A pallet is a portable platform generally including a planar horizontal member, which can be used as a base member for stacking, storing, handling and transporting materials or goods. Generally, pallets are constructed from wood and nails or staples. Recently, pallets have also been constructed from paper-based materials and plastics. Pallets generally have openings in the structure thereof to accommodate the forks of a forklift truck, or the like, and allow the pallet to be lifted off a floor.

U.S. Pat. No. 5,269,219 relates to a pallet design for transporting loads fabricated from paper products consisting of a load-supporting deck, a top cover sheet with tuck tabs that provides a fastening and link to the runners, a bottom sheet glued to the deck that provides a solid surface to attach the runners, and runners spaced apart and at the appropriate height to provide access to the forks on a forklift or hand jack.

U.S. Pat. No. 5,595,125 relates to a lightweight, disposable, corrugated paper pallet formed by a plurality of corrugated paper runners, traversing the length of the pallet, each runner enveloped by a continuous corrugated paper inner sheet, which itself is bonded to the lower side of a reinforced corrugated paper top deck and to the upper side of a corrugated paper bottom stabilizing deck.

U.S. Pat. No. 5,784,971 relates to a collapsible pallet assembly structure which includes at least a pair of lengthwise beam members and at least a pair of crosswise beam members formed of a corrugated paper material. Each lengthwise bead member includes a surface plate portion from which a plurality of folded sidewall portions extend downward and at least one wing piece portion projects in substantially coplanar manner. The surface plate portion has formed therethrough a plurality of upper slot holes which communicate respectively with a plurality of lower slot holes formed through the sidewall portions. Each crosswise beam member includes a top plate portion from which a plurality of folded bracket plate portions extend downward. Each bracket plate portion includes a slotted opening that delineates a pair of bracket plate extending sections. Each crosswise beam member is coupled to the lengthwise beam members in a transverse manner with its top plate portions partially overlaying at least one of the lengthwise beam members surface plate portions and with at least one extending section of each bracket plate portion inserted through an upper slot hole of a lengthwise beam member surface plate portion.

U.S. Pat. No. 5,934,202 relates to a paper pallet which includes a bottom deck board made of a corrugated paper board, a top deckboard made of a corrugated paper board, a plurality of paper blocks longitudinally and transversely arranged in rows and connected between the bottom deckboard and the top deckboard, and a plurality of paper packing members respectively adhered between the paper blocks and one of the bottom deckboard and the top deckboard, the packing members each having an elongated base adhered between one of the bottom deckboard and the top deckboard and one row of the paper blocks and pairs of packing flaps bilaterally extended from two opposite long sides of the elongated base and respectively adhered to the corresponding row of blocks at two opposite sides.

U.S. Pat. No. 6,357,364 relates to a paper pallet comprising support blocks, a top pad and a wrap. The support blocks are of a comb configuration, e.g., honeycomb or hexacomb. The top pad is of a corrugated material and is positioned above the support blocks. The wrap is also of a corrugated material and wraps, via direct contact, the top and side surfaces of the top pad as well as wrapping, via direct contact, at least two side surfaces of the support blocks.

The prior art paper-based pallets present rather complicated designs which are not cost effective to produce and are relatively bulky and heavy. The pallets of the prior art are labor intensive and often not completely recyclable.

SUMMARY OF THE INVENTION

Support members are disclosed which can be employed as substitutes for wood braces, supports, or the like. The support members are preferably constructed from corrugated paper and have a high strength to weight ratio. The support member is generally formed from single face corrugated which is wound around a central area or core to form an elongated body having dimensions similar to the wood article it can replace.

In a further embodiment, an object of the present invention is to provide a pallet, preferably constructed of corrugated paper, which while being lightweight has sufficient strength to support materials or goods to be transported. Advantageously, the pallet can be recycled and poses no harmful effects on the environment.

A further object of the invention is a pallet structure that is easily customizable and can be manufactured in a vast number of size ranges to suit the varying needs of customers.

The pallet of the present invention generally comprises an upper deck member, a lower deck member, and a plurality of support members connected therebetween. The upper deck member and the lower deck member, independently, are disposed at a horizontal plane substantially parallel to each other as well as a ground surface. The support members comprise a single continuous wind of corrugated paper linerboard, which is preferably single faced, having a continuous layer of paper with strengthening flutes attached thereto. The continuous wind of the support members provides strength and rigidity to the pallet.

In one embodiment, the pallet is constructed from two or more support members which substantially extend the length or width of the deck members and allow two-way access for a forklift truck. In a further embodiment, the support members include access holes perpendicular to the longitudinal axis thereof so that the pallet can be accessed from all four sides for lifting and/or moving.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

The embodiments of the pallet and associated components thereof according to the present invention will be specifically described, with reference to the drawings wherein like numerals indicate like or corresponding parts throughout the Figures.

Figure 1:
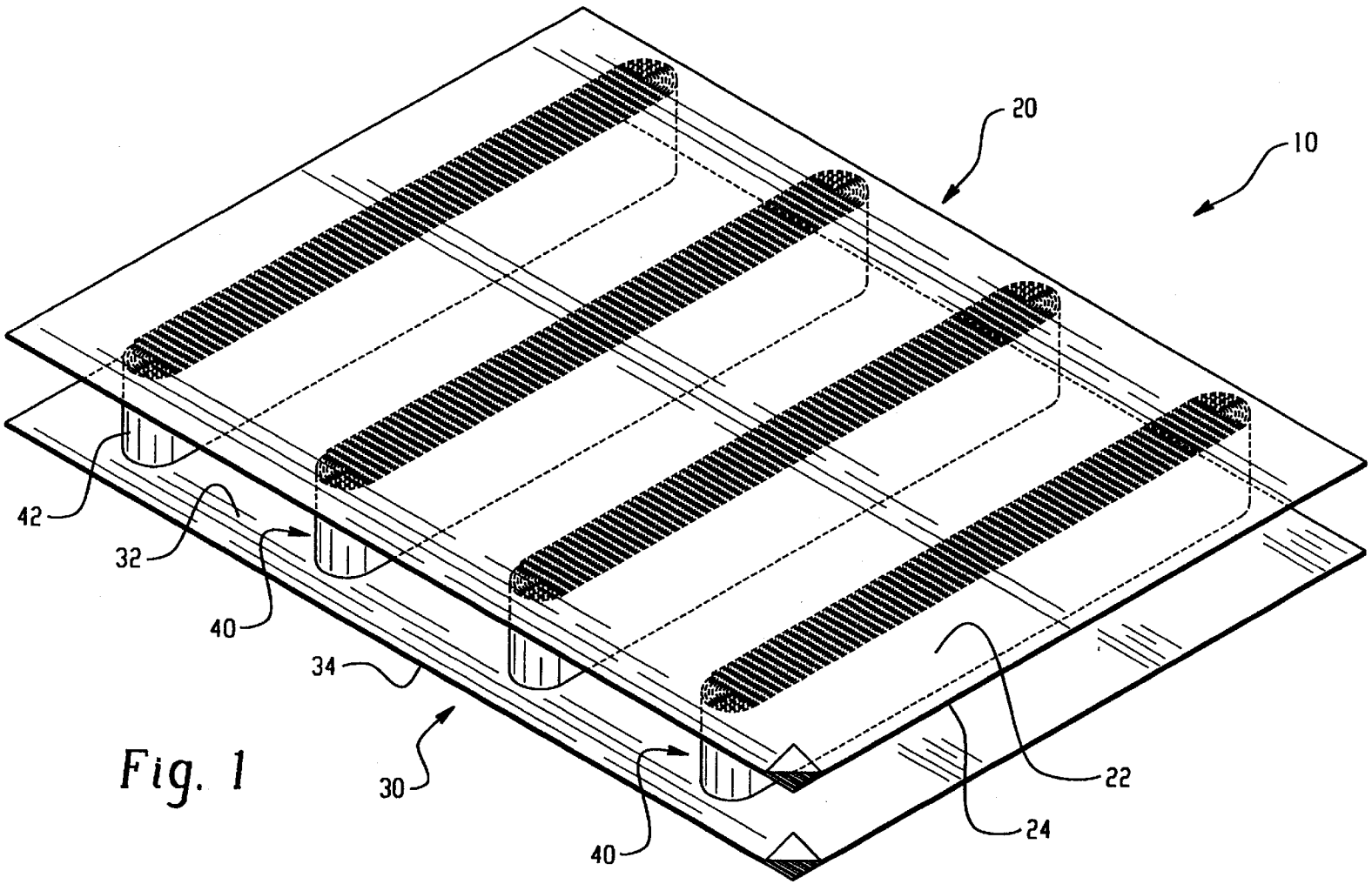
FIG. 1 is a perspective view of a corrugated paper pallet of the present invention showing the upper and lower deck members connected by support members.

FIG. 1 illustrates a pallet 10 of the present invention which comprises an upper or top deck member 20, a lower or bottom deck member 30, and a plurality of support members 40. The support members are secured at predetermined locations between the deck members by a securing means, such as adhesive, tape, fasteners, or the like, with common white glue being preferred.

Figure 3:
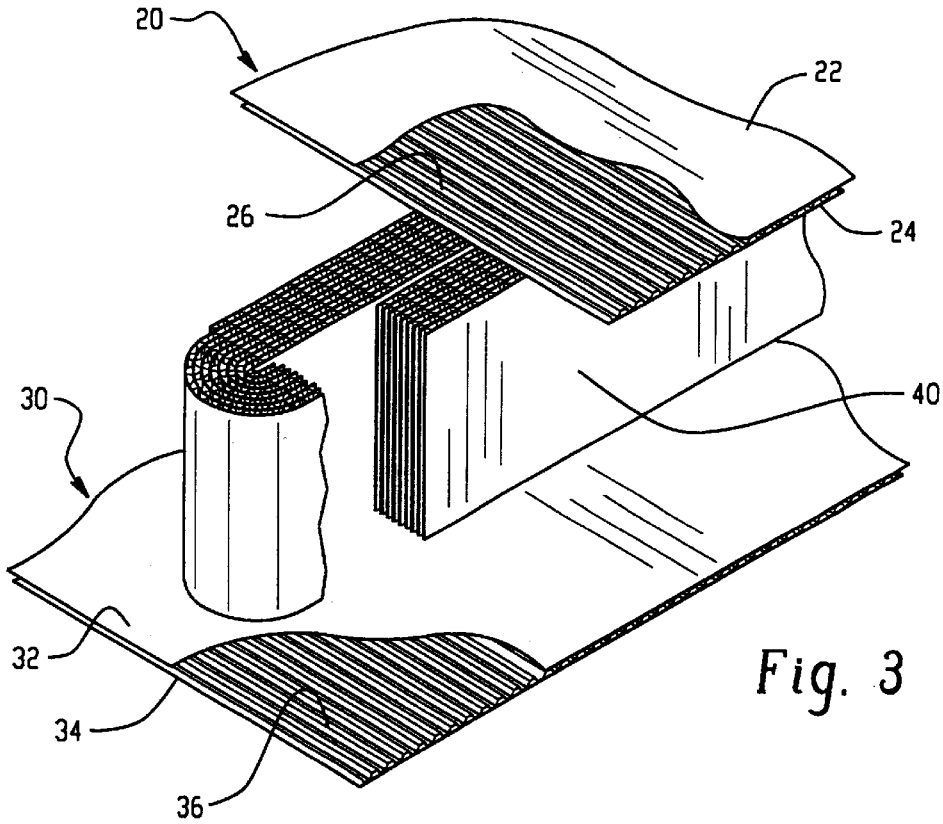
FIG. 3 is a partial perspective view of a pallet with removed portions to particularly illustrate the orientation of the flutes of the corrugated members.

The upper deck member 10 typically serves as a support or load-bearing surface for the goods or materials adapted to be stored on and/or transported by the pallet. The upper deck member is preferably formed from a single sheet of corrugated linerboard paper. The corrugated paper can be single wall, double wall or triple wall. As known in the art, single wall corrugated sheets are formed from two face sheets, 22, 24 connected by a layer of flutes 26, as shown in FIG. 3. The individual double wall and triple wall corrugated sheets include two and three layers of fluting, respectively, each separated by a single layer of thin paper or sheeting, with a layer of the paper or sheeting covering the outer surfaces of the outer flutes. Accordingly, the double and triple wall corrugated sheets have alternating layers of flutes and thin paper layers, with the paper layers being the outer surface of the sheets. The flutes can be described as having a repeating "S" shaped pattern or wave profile. The height of the flutes, i.e., from peak to trough, can vary as known in the art and can be, but are not limited to, A, B, C, and E grade. When double or greater wall corrugated sheet is utilized, different grade and thus different heights of flutes can be used in a single sheet of the corrugated paper, with B and C grade preferred for double wall sheets and A, B, and C; or A, C, and C preferred for triple wall. The flutes of the corrugated sheeting form hollow tube or straw-like passageways and connect the remaining layers together.

Top deck member 20 is a planar structure having a predetermined length and width, with sizes for both ranging generally from about 12 or 14 to about 50 inches, and preferably from about 30 or 40 to about 48 inches.

The main plane formed by the upper deck member is substantially horizontal and parallel to the lower deck member and adapted to be parallel with a ground surface. The top member is maintained a predetermined distance, usually about 3 to about 5 or 6 inches from the lower deck member 30.

The lower deck member 30 can be formed in the same size, manner and construction as the upper deck member 20. Depending on the intended use of the pallet, the corrugated sheets of the upper and lower deck members can be the same or different such as both being single wall corrugated paper, or one member being single wall and the other triple wall, etc. The lower deck member contacts or rests upon the ground surface. The planes formed by the upper and lower deck members are, as noted, substantially parallel and thus provide a level surface for goods or materials.

The support member or stringers 40 of the pallet provide both strength and rigidity to the structure. Each individual support member is formed from a single continuous piece of corrugated paper, such as single face. Alternatively, a plurality of pieces such as generally about 10 or about 8 or less, desirably about 6 or about 4 or less, and preferably about 3 or about 2, can be utilized and the same are butted at their ends to one another, either with or without a fastener such as an adhesive and wound in the same manner as a single continuous piece of corrugated paper. The continuous piece of a predetermined height is wound or wrapped in a direction around itself to form a predetermined length and width or thickness. Support member 40 is preferably formed from single face corrugated paper comprising a single layer of paper with flutes co-extending therewith. Glue or other adhesive is utilized to secure the continuously wound layers to each other. During formation of the support member, the glue is preferably applied to the outer flute edges that will contact the succeeding paper layer. The continuous wind has a continuous nature of alternating layers of flute and liner or paper.

The overall size of a support member 40 can vary with the height ranging generally from about 3 inches to about 5 or about 6 inches, desirably from about 3.5 to about 4 inches, and preferably about 3.5 inches; the width ranging generally from about 2 to about 4 or about 6 inches, desirably from about 2 to about 3 inches, and preferably from about 2 to about 2.5 inches; and the length ranging generally from 12 or 14 to about 50 inches; desirably from about 40 to about 48 inches and preferably from about 46 to about 48 inches.

The support member flutes are arranged parallel to the height of the support member to provide strength. In this manner, the deck members will cover the open ends of the support member, which are then fully enclosed. The overall dimensions of a support member will vary and depend on the intended use and weight the pallet will be used to support.

Often a support member will run substantially the entire length of a pallet from one side or end to another. The number of support members utilized between the deck members will also depend on the weight that needs to be supported, and preferably about 2 or about 3 to about 6 support members are utilized in a pallet.

In a preferred embodiment, the flutes 26, 36 of the deck members 30,40 are disposed in a direction perpendicular to the longest length (as opposed to the width) of the support members, thus providing strength to the pallet as shown in FIG. 3. Thus, the flutes of the support members are perpendicular to the flutes of the deck members. This configuration is also illustrated in FIG. 2 and has been found to provide a lightweight, recyclable pallet which is strong and sturdy in construction.

Figure 2:
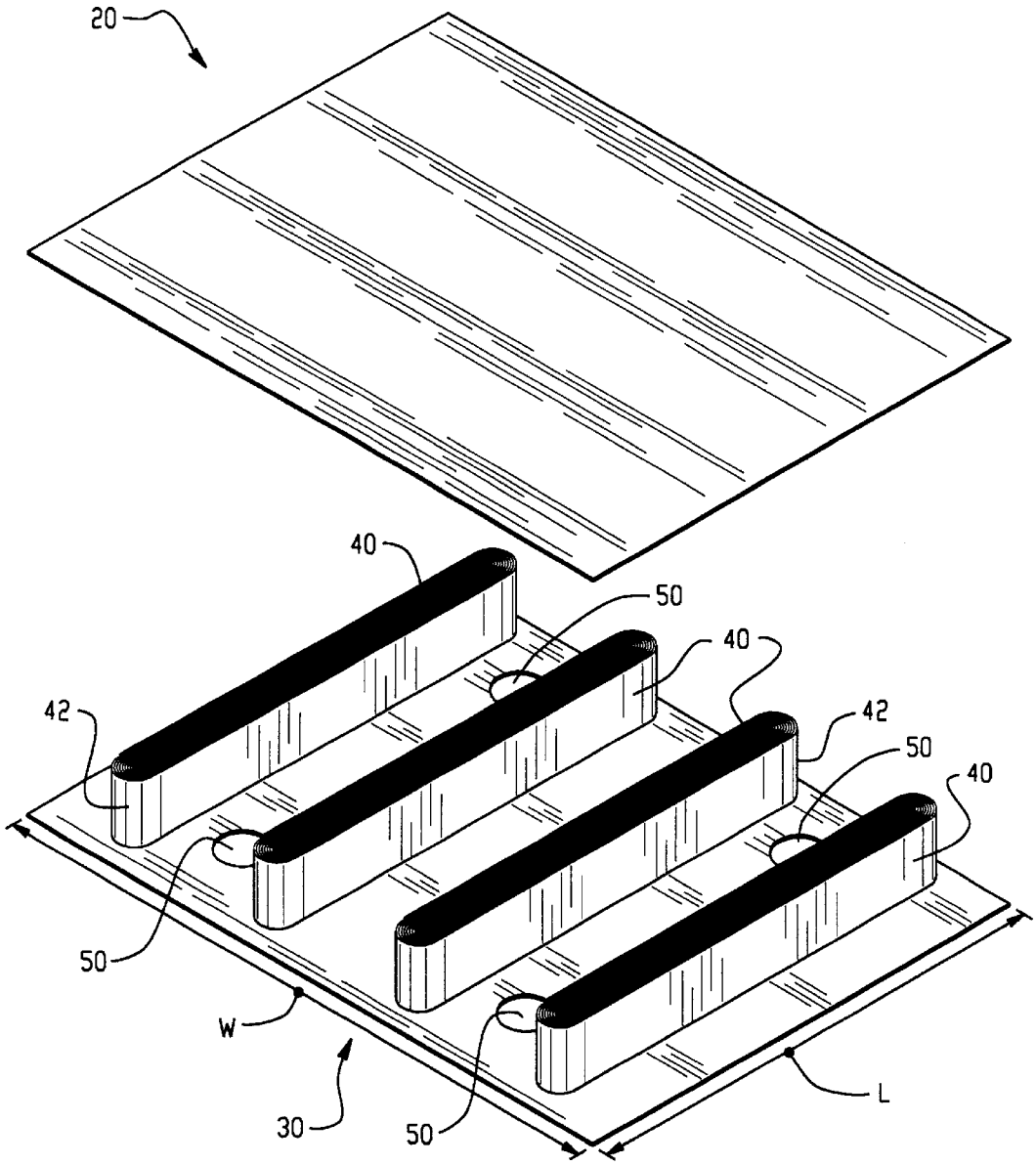
FIG. 2 is an exploded view of a pallet showing the continuous wind or wrap of the support members.

As shown at least in FIG. 2, support members 40 preferably have rounded or curved end portions 42. The curved end portions are adapted to guide the forks of a fork lift truck into the pallet. This is, the curved end portions will allow the forks to slide into the passageways formed between adjacent support members.

FIG. 3 is a detailed cross-sectional view of a pallet of the present invention, particularly illustrating the orientation of the flutes of the corrugated members. The flutes 26 of the upper deck member 20 are orientated in a direction perpendicular to the length of support member 40. The upper deck member is a single wall corrugated paper sheet having face paper layers or sheets 22 and 24 connected by flutes 26. In a similar manner; the lower deck member includes face paper layers or sheets 32 and 34 connected by flutes 36, which are also orientated perpendicular to the length of support member 40.

Figure 4:
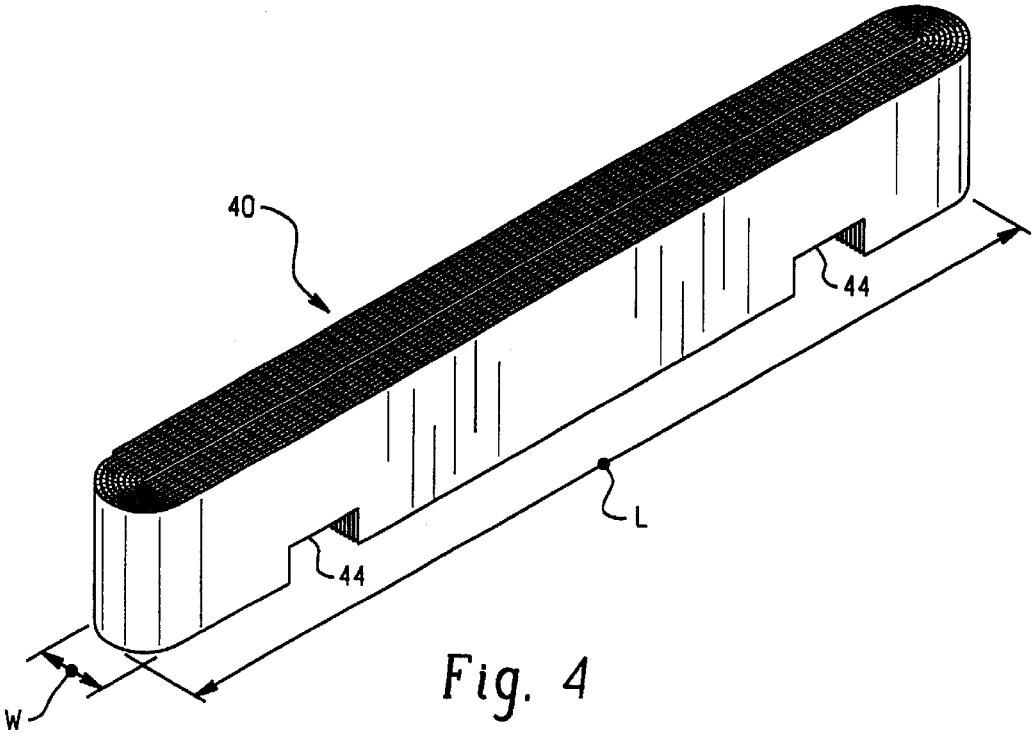
FIG. 4 is a perspective view of a support member which can be utilized as a substitute for wood pieces.

FIG. 4 illustrates a support member 40 which can be utilized to create a four-way entry pallet. Support member 40 includes at least two cut-outs 44 which extend completely through the width of the support member. The size of the orifice or cut-outs can vary and are at least large enough to accommodate a fork of a fork lift truck. The cut-outs 44 enable the pallet of the present invention to be entered from all four sides for lifting and moving the same.

In a further embodiment, as illustrated in FIG. 2, the lower deck member 30 can have jack holes 50 formed therein to accommodate lift wheels of a hand jack. The jack holes 50 can be formed of any shape or size and are generally at least adapted to be larger than the size of the lift wheels of the hand jack. Jack holes 50 allow the pallets to be utilized and lifted by hand jacks which are generally manually operated. The hand jacks generally include wheels on the fork portions for rolling movement across the ground surface. The jack holes 50 are adapted to allow the wheels of a hand jack to be freely moved, as the wheels are prevented from contacting the pallet 10 due to the presence of the jackholes.

Additionally, either or both of the upper and lower deck members can be treated with an oil and/or water repellent compositions as known in the art and to the literature to prolong the life of the pallet. The pallets of the present invention being formed of corrugated paper are completely recyclable and are thus beneficial to the environment. The construction of the pallet also renders the same insect resistant.

In a further embodiment, a support member or article can be utilized alone, that is not in a pallet assembly. The support member is used as a wood substitute and is used as, but not limited to, stack separators, supports, spacers, braces, stabilizers, and the like.

As stated hereinabove, the support members 40 are generally elongated in length as shown in at least FIG. 4. In addition to the above-noted size ranges for the support members used in a pallet assembly, support member construction is versatile and thus a support member is sized accordingly to fit an intended application. For example, in one embodiment the support member is used as a brace on the floor of a truck trailer or rail car; or used between adjacent items or rows of items. The support member 40 is formed in sizes of about 0.50×about 2×about 2 inches to about 8×about 8×about 50 or about 100 inches or from about 1×about 2×about 2 inches to about 6×about 6×about 50 inches. In further embodiments, the support member is also be manufactured to typical wood board specifications similar to 2"×4", 4"×4", or 2"×6" in substantially any desired length. In one embodiment, two or more support members are glued together, i.e., side by side, one on top of the other, or the like if desired to provide a larger surface area.

Although the relative size of the support member can vary, the construction method is generally the same. The support member is formed as a wind or coil of corrugated paper. The wind is considered a spiral wind, more specifically a flattened, elongated wind or coil. As disclosed hereinabove, the support member is preferably formed from single face corrugated paper having a corrugated paper layer of a predetermined thickness and a flute layer attached thereto; typically with an adhesive as known in the art. The assembled flattened, spirally wound or rounded end rectangular support member has alternating layers of paper sheet and fluting.

As stated hereinabove, the flutes can be, but are not limited to, A, B, C, or E grade. The paper layer of the corrugated paper generally ranges from about 23 to about 90-pounds per msf (thousand square feet) in medium or linerboard as known in the art. Advantageously, the weight or thickness of the paper is exactly tailored to fit the desired end use, wherein if more support or strength is needed, a heavier grade of paper is utilized. Thus, the support members can be custom tailored to specific applications.

The support member 40 is generally formed in the following manner. Starting with a first end 41, corrugated paper of a predetermined height is extended a predetermined length "X" forming a central area or core 42, preferably in a straight line so that when a predetermined number of layers are wrapped or wound around the central core, a support member is formed having a total length L and width W. When the corrugated paper has been extended to length "X," the paper is then bent or folded either clockwise or counterclockwise and routed back along and adhered to central core 42. When the first end 41 is reached, the corrugated paper is wrapped therearound. The process is repeated until the central area is wrapped with a desired number of layers.

Each layer of paper of the support member is preferably adhered to an adjacent layer with an adhesive. As illustrated in the FIG. 4, the flute layers and sheet layers alternate. End 43 of the corrugated paper can be essentially located at any point along the outside of the support member, and is not limited as shown in FIG. 4. While the support member can be formed from a single piece of corrugated paper, it should be understood that more than one piece can be utilized with ends being abutted or even slightly overlapped.

The support member of the present invention has excellent strength. The wrapped structure provides rigidity and stability to the support member. The curved end portion 45 is very stable and aids in preventing separation between the layers. The support member is used wherever bracing, support or the like are needed. The support member provides cushioning properties and absorbs vibrations which can occur in transit, thereby reducing damage to a product.

Moreover, the support member is free of nails, splinters, or other protrusions harmful to products which can be supported thereby. The support members are recyclable and repulpable, thereby reducing waste in landfills.

EXAMPLES

Example 1

A two-way entry pallet of the present invention was constructed having an upper deck, a lower deck, and four support members. Both the upper deck and lower deck had dimensions of 40 inches wide by 48 inches long and were formed from a single sheet of single wall corrugated paper, 75-pound version. The support members were each constructed from a single sheet of single face corrugated paper. Glue was applied to the flute edges and the single piece of single face corrugated paper was wrapped around itself to form a support member 3½ inches high, 48 inches long and 2 inches wide. Two support members were placed at the width ends with the remaining supports being disposed therebetween at equal distance intervals from the remaining support members. The deck members were adhered to the support members utilizing common white glue.

7,200 pounds of weight was placed on the pallet. The pallet maintained its initial shape and dimensions and did not deform under the pressure of the weight for two weeks when the load was removed.

Example 2

Compression Test

A pallet having the above-noted construction and dimensions as in Example 1 was placed in a gauged hydraulic press. Pressure was then applied to the top and bottom deck members of the pallet and increased incrementally. The pallet withstood 17,000 pounds of pressure before being compressed.

While in accordance with patent statutes the best mode and preferred embodiment have been set forth, the scope of the invention is not limited thereto, but rather by the scope of the attached claims.

What is claimed is:

1. An elongated support article, comprising:

one or more pieces of corrugated paper comprising a) a layer of paper having a length, a width, and a height, and b) flutes connected to said layer of paper, said flutes arranged parallel to the paper height, said support article having an elongated linear core of a predetermined length formed from said corrugated paper, said corrugated paper further wrapped in a clockwise or counterclockwise direction around said core in one or more layers to form said support article having a solid wrap of contiguous layers, and a predetermined length, height, and width, and wherein said support article length is at least twice the support article width.

2. A support article according to claim 1, wherein said flutes are A, B, C or E grade, or a combination thereof, and wherein said layer of paper is from about 23-pounds to about 90-pounds per thousand square feet.

3. A support article according to claim 2, wherein said support article width, height, and length respectively is from about 0.5 inch by about 2 inches by about 2 inches to about 8 inches by about 8 inches by about 50 inches.

4. A support article according to claim 3, wherein said support article width, height, and length respectively is from about 1 inch by about 2 inches by about 2 inches to about 6 inches by about 6 inches by about 50 inches.

5. A support article according to claim 3, wherein one piece of corrugated paper is utilized to construct said support article, and wherein the length end portions of the support article are curved.

6. A support article according to claim 5, wherein an adhesive attaches said corrugated paper layers to each other.

7. A support article according to claim 3, wherein two or more pieces of said corrugated paper are utilized to form said support article, and wherein the length end portions of the support article are curved.

8. A support article according to claim 7, wherein an adhesive attaches said corrugated paper layers to each other.

9. An elongated support article, comprising:

a solid, flattened spiral of one or more pieces of corrugated paper forming an elongated linear core and one or more layers of said corrugated paper contiguously wound around said core in a clockwise or counterclockwise direction, said support article having a length, a width, and a height, said corrugated paper comprising a layer of paper and flutes connected to the layer of paper, and wherein said support article length is at least twice the support article width.

10. A support article according to claim 9, wherein said flutes are A, B, C or E grade, or a combination thereof, and wherein said layer of paper is from about 23-pounds to about 90-pounds per thousand square feet.

11. A support article according to claim 10, wherein said support article width, height, and length respectively is from about 0.5 inch by about 2 inches by about 2 inches to about 8 inches by about 8 inches by about 50 inches.

12. A support article according to claim 11, wherein two or more pieces of said corrugated paper are utilized to form said support article.

13. A support article according to claim 11, wherein one piece of corrugated paper is utilized to construct said support article.

14. A support article according to claim 1, wherein an adhesive attaches said corrugated paper layers to each other.

15. A method for forming an elongated support article, comprising the steps of:

forming an elongated core from corrugated paper; and wrapping one or more layers of corrugated paper around said core to form said support article having a solid wrap of contiguous layers, a length, a width and a height, wherein said corrugated paper comprises a layer of paper and a layer of flutes, and wherein said support article length is at least twice the support article width.

16. A method according to claim 15, wherein said flutes are A, B, C or E grade, or a combination thereof, and wherein said layer of paper is from about 23-pounds to about 90-pounds per thousand square feet.

17. A method according to claim 16, wherein said support article width, height, and length respectively is from about 0.5 inch by about 2 inches by about 2 inches to about 8 inches by about 8 inches by about 50 inches.

18. A method according to claim 17, wherein one piece of corrugated paper is utilized to construct said support article.

19. A method according to claim 18, wherein an adhesive attaches said corrugated paper layers to each other.

20. A method according to claim 17, wherein two or more pieces of said corrugated paper are utilized to form said support article.

* * * * *